United States Patent [19]

Richter et al.

[11] 4,388,946

[45] Jun. 21, 1983

[54] VALVES

[75] Inventors: Rudolf Richter, Hosbach; Walter Kropp, Aschaffenburg, both of Fed. Rep. of Germany

[73] Assignee: Linde Aktiengesellschaft, Hollriegelskreuth, Fed. Rep. of Germany

[21] Appl. No.: 255,388

[22] Filed: Apr. 20, 1981

[51] Int. Cl.[3] ..... F15B 11/04; F15B 13/02

[52] U.S. Cl. ..... 137/596.2; 91/446; 137/596; 137/625.68

[58] Field of Search ..... 91/446; 137/596, 596.2, 137/625.68

[56] References Cited

U.S. PATENT DOCUMENTS

| | | | |
|---|---|---|---|
| 2,946,347 | 7/1960 | Ruhl | 137/596.2 |
| 3,910,311 | 10/1975 | Wilke | 137/596 |
| 4,187,877 | 2/1980 | Hodgson et al. | 137/596 |

FOREIGN PATENT DOCUMENTS

| | | | |
|---|---|---|---|
| 2647140 | 4/1978 | Fed. Rep. of Germany | 137/596 |
| 2649775 | 5/1978 | Fed. Rep. of Germany | 137/596 |
| 543716 | 3/1977 | U.S.S.R. | 137/596 |

*Primary Examiner*—Gerald A. Michalsky

*Attorney, Agent, or Firm*—Buell, Blenko, Ziesenheim & Beck

[57] ABSTRACT

A valve is provided, particularly as a part of a block control device, made up of an elongate housing having a longitudinal bore with spaced work chambers, inlet chambers and exhaust chambers intersecting the bore and an elongate cylindrical spool slidable in said bore, having a second bore in each end of said spool, a brake piston movable in each second bore, a pair of restrictor passage means one in said spool and one in said brake piston connecting the interior of said spool with both ends of each bore in the spool on opposite ends of the piston, a pair of spaced transverse passages at each end of the spool communicating with each bore in the spool and spaced to connect a work chamber and pressure fluid chamber at one end of the spool and a work chamber and exhaust chamber at the other end of the spool in a work position, an annular groove in the brake piston capable of connecting said spaced passages within the bore in the spool whereby in said work position pressure fluid flows from a pressure fluid chamber through said transverse passages to a work chamber at one end of the spool, and the pressure fluid from a pressure fluid chamber through said restricting passages to act on the brake piston to move it to position the groove between the passages at the other end of the spool to regulate flow of fluid between the work chamber and exhaust chamber in accordance with the relative pressure in the pressure fluid chamber.

6 Claims, 1 Drawing Figure

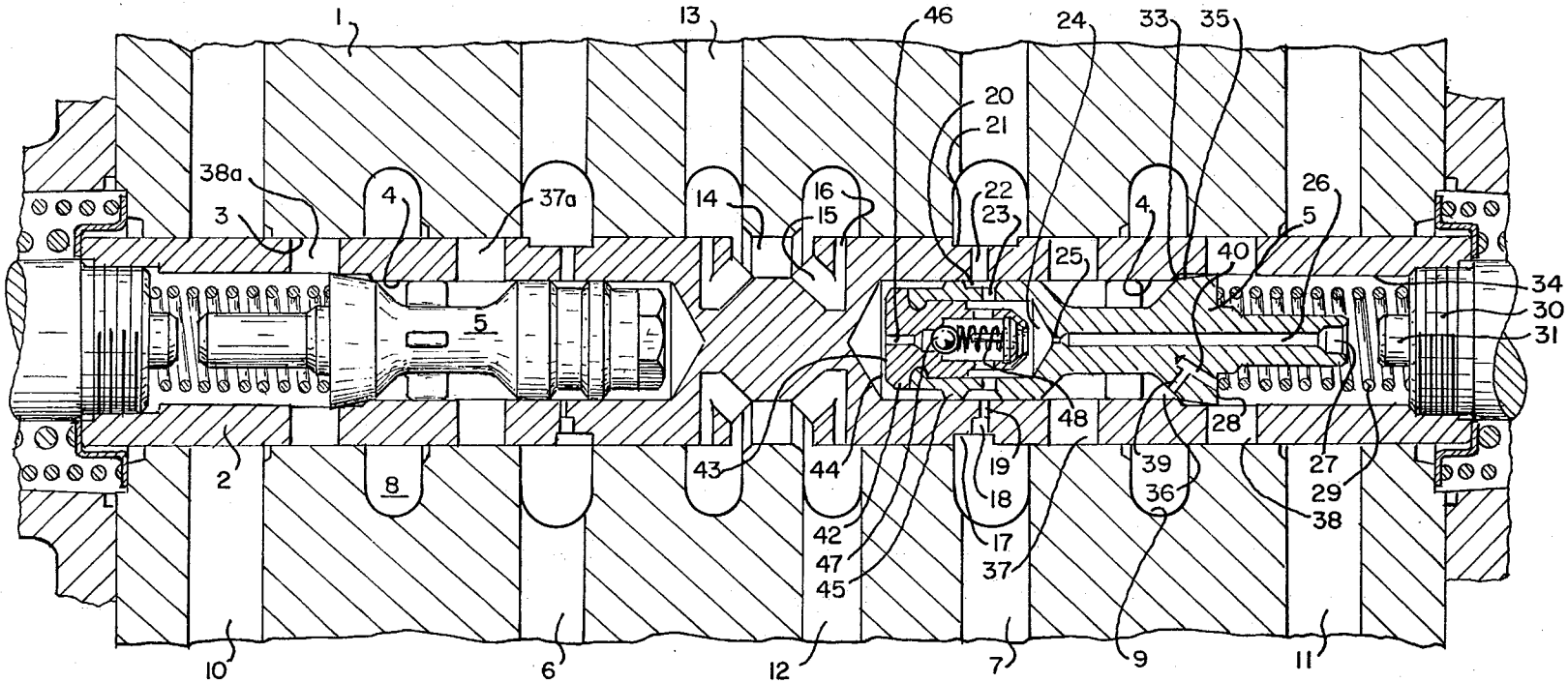
34
30
31
26
5
27
29
38
11
35
40
28
33
4
39
36
9
24
25
48
37
7
20
21
22
23
19
18
17
46
16
15
44
42
47
45
12
13
14
43
37a
6
5
4
8
1
38a
3
2
10

VALVES

This invention relates to valves and more particularly to a valve used as a part of a sliding spool valve in a block control device for controlling the connection between a pump and a pressure energy consumer, particularly a reversible energy consumer that can be acted upon in two directions and which drives a consumer of mechanical energy.

Control valves are well-known in the hydraulic industry for controlling the flow of pressurized fluid to a consumer of pressurized fluid such as a hydraulic motor or a hydraulic cylinder and the return flow from the consumer to a non-pressurized reservoir. It is equally well-known that cavitation and other similar problems can arise where a consumer is applying pressure from a load onto the return fluid which makes the consumer discharge fluid from one side faster than the pump can deliver fluid to the other side of the consumer. An example is that of a hydraulic cylinder on an excavator having a loaded bucket in the raised position to be dropped rapidly to ground level. If the valve is shifted fully to permit the load to drop it may force fluid to reservoir faster than the pump can deliver fluid to the other side causing cavitation and other related problems resulting from the inability of the pump to feed fluid sufficiently rapidly to the consumer.

A variety of solutions to this problem have been proposed. Spool valves having a brake piston have been proposed. In spools valves of the prior art with brake pistons the latter serves to brake the arrangement provided as the consumer by throttling the flow leaving the consumer when the latter (the arrangement designed as a consumer of hydraulic energy) is driven in the braking state, such that its velocity of motion matches the stream flowing in from the pump. One difficulty here is obtaining a suitable pressure signal for controlling the brake piston on the drain side because on this side the pressure is relatively low, while the pressure is higher in spite of the braking effect on the inflow side from the pump to the arrangement designed as the consumer, e.g. a hydraulic piston, in which case, however, the brake piston is pressed against a spring of equal force on both sides in order to achieve the symmetry desired for controlling both directions of motion. A typical solution for this problem in function and effect is known from German DE-OS 2,647,140. However, this solution requires additional bores in the housing.

The present invention proposes a valve arrangement with brake piston without additional bores in the housing, which facilitates a continuous braking of the arrangement designed as the consumer, e.g. a hydraulic piston, and prevents the latter from moving faster than would correspond to the stream flowing in from the pump, in order to prevent filling deficiencies, e.g. cavitation.

The present invention provides a solution to this problem which does not require additional bores in the housing and can be incorporated in the standard envelope or housing of a conventional spool valve. In the present invention there is provided a valve, having a sliding spool located in a bore in a spool housing, to which feed and drain channels are radially connected for controlling the fluid connection between a pump and a preferably reversible pressure-energy consumer that can be acted upon in both directions and which drives a consumer of mechanical energy, which is capable of furnishing mechanical energy under certain operating conditions, in which case the sliding spool has an annular groove that, in the neutral position of the sliding spool, connects an annular space or chamber connected with the pump in the housing surrounding the sliding spool with a chamber connected to a drain line and can be shifted out of this neutral position into at least one position in which the chamber connected with the pump is connected through the sliding spool with a chamber in the housing connected with the feed line to the consumer and at the same time a chamber connected with the return line of the consumer is connected through the sliding spool with the drain line, in which case a brake piston capable of moving against the force of a spring and serving to throttle the flow from the consumer to the drain is located in an axial bore of the sliding spool and can be acted upon by pressure on one face, in which case the fluid under pressure flows through a feed bore in the sliding spool to the space in front of this face and where this brake piston in turn also has an annular groove which, in the position of the brake piston displaced against the force of the spring, connects transverse bores in the sliding spool with each other, one of which is connected with the return line from the consumer and the other is connected with a chamber connected with the reservoir when the sliding spool is shifted in position, and characterized in that a restrictor is located in the feed bore in the sliding spool and that another restrictor is located in the subsequent flow path of the pressure medium passing through the feed bore, and that the face of the brake piston is acted upon from a space that lies in the said pressure-medium flow path between the two restrictors.

Preferably the connection between the space in front of the second restrictor and the space in front of the face of the brake piston is formed by a slot on the periphery of the brake piston. The space in front of the second restrictor is preferably connected with the space in front of the face of the brake piston through a second connecting channel in which a check valve opening to the space in front of the second restrictor is located. Preferably the rear (in the direction of closure) edge of the annular groove of the brake piston is designed as a valve seat that works together with the annular surface in the sliding spool at least one by-pass line is preferably present as a by-pass of the valve seat in the brake piston. Preferably, another bore is located in the sliding spool such that it is connected in parallel to the restrictor on the side controlling the flow of the consumer.

In the foregoing general description we have set out certain objects, purposes and advantages of this invention.

Other objects, purposes and advantages of this invention will be apparent from a consideration of the following description and the accompanying drawing showing a valve according to this invention in longitudinal section.

In the drawing we have illustrated a housing 1 having a bore 3, in which a spool 2 is capable of sliding longitudinally. The spool 2 is provided with a bore 4 at each end and coaxial with the longitudinal axis of the spool. Each bore 4 is provided with a brake piston 5 slidable therein axially of the bore.

Several chambers that are arranged as grooves radial to bore 3 or as annular spaces around bore 3 are provided in the housing 1. Of these chambers two, 6 and 7, are connected with the pump (not shown in the drawing). Chamber 8 is connected with one side of the arrangement designed as the consumer and chamber 9 is connected with the other side of this arrangement. The chambers 10, 11, and 12 are connected with a drain line to a pressureless reservoir. Chamber 13 is connected with a like annular space or chamber around another bore (not shown in the drawing), in which another valve spool (not shown in the drawing either) is capable of sliding such that in the neutral position of this additional valve spool (not shown) the channel 13 is connected with the pump, while channel 13 is blocked off in the control positions of this additional valve spool.

An annular groove 14 that connects chamber 13 with chamber 12 in the neutral position of valve spool 3 (as shown in the drawing) is provided in the valve spool 2. Additional lateral bores 15 and 16 still facilitate a restricted flow from chamber 13 to chamber 12 with partial displacement.

A lateral bore or well 17 is provided in the sliding spool 2; it is connected with a laterally displaced bore 18, from which a restrictor bore 19 (e.g., 1 mm in diameter) empties into the bore 4, i.e., in a section of this bore 4 that is in constant connection with the annular groove 20 in the brake piston 5.

Displaced in the peripheral direction with respect to the bore 17, another bore or well 21 is provided in the sliding spool 2, from which another bore 22 also empties into the bore 4. Bore 21 is designed so that it lies in front of the wall of bore 3 between chambers 7 and 9 or 6 and 8 when the sliding spool 2 is shifted out of the neutral position.

In the brake piston 5 another bore 3 passes radially out from the annular groove 20 to an internal space 24 to which the longitudinal bore or passage 26 is connected through another restrictor bore 25. The longitudinal bore 26 empties into the outer face 27 of the brake piston 5.

A spring 29 presses against a shoulder 28 of the brake piston 5; this spring also presses against a plug 30. In the fully modulated state of brake piston 5 the latter lies with its face 27 against an extension 31 of plug 30 so that passage 26 is blocked off.

The bore 4 is designed as a stepped hole, whose expanded section 34 forms an annular surface 33 with the narrow section of bore 4, against which the brake piston 5 lies with its valve seat surface 35. In front of the latter, an annular groove 36, through which the bores 37 and 38 in the sliding spool 2 can be connected with each other in the controlled state of the brake piston 5, is formed in the brake piston 5, in which case bore 38 is connected with chamber 11 and bore 37 with chamber 9 on the one side, e.g., with displacements to the right in the drawing, in the controlled state of the sliding spool 2, and, on the other side, bore **37*a* is connected with chamber 6 and bore 38*a* with chamber 8. When sliding spool 2 is moved to the left in the drawings, bore 38*a* becomes connected with chamber 10, bore 37*a* with chamber 8, bore 37 with chamber 7, and bore 38 with chamber 9**.

Two bores 39 and 40, which are interconnected, are provided in the brake piston 5 for by-passing the valve seat 33, 35; in fact, two bores, whose axes form an angle with each other, are provided instead of one straight bore passing all the way through, in order to align the forces arising during the throughflow more favorably.

Annular groove 20 is connected through a gap formed on the periphery of section 45 of brake piston 5 with the space 44 in front of the face 43 of the brake piston 5. For production reasons, the face 43 is formed on a stopper section 42, which is screwed into the brake piston 5. A longitudinal bore 46, which can be closed off by a check valve ball 47, is provided in the stopper section 42, in which case the ball 47 presses against a spring 48. The space 44 in front of the face 43 of brake piston 5 is thus connected through the groove 46 and the check valve 47, 48 with space 24.

The mode of operation is as follows.

When the sliding spool 2 is in the control position, bore 17 is connected with chamber 7 on the inflow side of the pump so that pressure medium flows from the pump through chamber 7, bore 17, bore 18, restrictor 19, bore 23, space 24, the other restrictor 25, and the longitudinal bore 26 to the space in front of face 27 of brake piston 5 connected with a pressureless drain. A restrictor chain is thus formed by the series-connected restrictors 19 and 25, in which case the space 24 lies between the two restrictors 19 and 25 so that the pressure in space 24 is formed by the ratio of the widths of the two restrictors 19 and 25. It is assumed that the two restrictors 19 and 25 are approximately identical in size; thus, the pressure in space 24 is approximately half as great as that in chamber 7. The pressure prevailing in space 24 also prevails however in the annular groove 20 and thus communicates through the gap on the periphery of section 45 with space 44 so that the brake piston is displaced against the force of spring 29 through the action of the pressure on the face 43. The displacement motion in moving against the force of spring 29 is damped by the throttling action in the gap on section 45. However, the displacement motion of the brake piston in the direction of closure on the valve seat 33, 35 can take place very rapidly because the check valve 47 opens during a displacement in this direction under the action of the spring 29 and thus the fluid present in the space 44 in front of the face 43 can flow very rapidly through the check vavle 47 into space 24 and from the latter through the longitudinal bore 26, in which case the throttling effect of restrictor 25 is considerably less than that at the gap on section 45.

The provision of seating valves in connection with sliding spools is familiar in itself. Such seating valves are ordinarily used in order to facilitate a tighter sealing than with a cylindrical slide valve in a cylindrical bore with a clearance that permits jamming-free movement. The purpose is different, however, in the application of a seating valve intended here.

Namely, if, instead of a seating valve, only one edge on one bore and one edge at the passage of the annular groove 36 to the cylindrical section of brake piston 5, as considered here, were provided in the usual manner, the brake piston 5 would have to extend in quite deeply in order to achieve a sealing effect, with the result that a rather long path would have to be traversed during the opening of the brake piston 5 and considerable time would be required to traverse this path until the edge of the annular groove 36 is freed. The dead time is thus substantially reduced by using the seating valve design.

By using the restrictor chain formed by the restrictors 19 and 25, it is not only possible to obtain a continuous signal, but also to achieve a higher control pressure on the face of the side controlled as the drain side, as on the feed side connected with the pump, so that a filling deficiency in the consumer is avoided. The goal of facilitating a constant braking of the consumer and avoiding a filling deficiency in it is thus reliably achieved. Furthermore, a simple accomodation in the control valve is facilitated.

In contrast to the drain side of the consumer, in which the said effect is achieved, the pressure medium can flow on the feed side to the consumer through the additional bore 22, so that the throttling effect in the restrictor bore 19, which is connected in parallel on the feed side to the additional bore 22, does not occur, with the additional result that a smaller pressure gradient is required on the inflow side for control.

In the foregoing specification we have set out certain preferred embodiments and practices of our invention, however, it will be understood that this invention may be otherwise embodied within the scope of the following claims.

We claim:

1. A valve structure for preventing filling deficiency problems in a pressure energy consumer such as a double acting hydraulic piston comprising an elongate housing having a longitudinal bore, an elongate cylindrical spool slidable in said bore, a pair of spaced work chambers surrounding and communicating with said bore and adapted to be connected to opposite sides of said pressure energy consumer, at least one pressure chamber intermediate the end of said bore communicating therewith delivering pressure fluid to said bore, at least two exhaust chambers, adjacent the work chambers and adapted to be connected to a reservoir, a second bore in each end of said spool, a brake piston in each said second bore, a third bore in said brake piston adjacent one end, at least one transverse passage in the wall of said brake piston communicating between the second and third bores, resilient means in each such second bore in said spool acting on said piston at the end opposite the third bore normally to urge the same toward one end of said second bore in said spool, a pair of cooperating restrictor passage means, one in said spool and one in said piston communicating from the third bore to the piston end adjacent the resilient means connecting the interior of said spool with both ends of each second bore in the spool on opposite ends of the piston, passage means in the brake piston communicating from the restrictor passages in the spool to the end of the second bore opposite the resilient means, a pair of spaced transverse passages at each end of the spool communicating with each bore in the spool and spaced to connect a work chamber and pressure fluid chamber at one end of the spool and a work chamber and exhaust chamber at the other end of the spool in a work position, an annular groove in the brake piston intermediate its ends capable of connecting said spaced passages within the bore in the spool whereby in said work position pressure fluid flows from a pressure fluid chamber through said transverse passages to a work chamber at one end of the spool, and the pressure fluid from said pressure fluid chamber through said restricting passages, at least one transverse passage in the brake piston and the passage means in the brake piston to act on the brake piston to move it against the resilient means to position the groove between the passages at the other end of the spool to regulate flow of fluid between the work chamber and exhaust chamber in accordance with the relative pressure in the pressure fluid chamber.

2. A valve as claimed in claim 1 having an exhaust chamber adjacent each end of said bore, a work chamber adjacent each exhaust chamber intermediate the same, and a pressure fluid chamber adjacent each work chamber intermediate the same.

3. A valve as claimed in claim 1 or 2 wherein each of the restrictor passage means includes a restrictor passage through the sidewall of the spool to the bore in the spool and a restrictor passage longitudinally of the piston whereby pressure fluid is delivered to both ends of the brake piston.

4. A valve as claimed in claim 1 or 2 wherein the brake piston is provided with an inner chamber, a first axial passage from said inner chamber to the end of the piston acted on by said resilient means, said first passage including a longitudinal restricting passage, a second axial passage from said chamber to the other end of said piston and check means in said second axial passage.

5. A valve as claimed in claim 1 or 2 wherein each of the bores in the spool has an enlarged portion at the end adjacent the end of the spool and the brake piston has a frusto conical portion designed to seat on the shoulder formed at the intersection of the enlarged portion with the bore.

6. A valve as claimed in claim 5 having a by-pass means in said frusto conical portion from the brake piston to the annular groove.

* * * * *

UNITED STATES PATENT AND TRADEMARK OFFICE

CERTIFICATE OF CORRECTION

PATENT NO. : 4,388,946

DATED : June 21, 1983

INVENTOR(S) : Rudolf Richter and Walter Kropp

It is certified that error appears in the above-identified patent and that said Letters Patent is hereby corrected as shown below:

Column 3, line 31, "bore 3" should read --bore 23--.

Signed and Sealed this

*Thirteenth* Day of *September 1983*

[SEAL]

*Attest:*

GERALD J. MOSSINGHOFF

*Attesting Officer*

*Commissioner of Patents and Trademarks*